US008440597B2

(12) United States Patent
Bugner et al.

(10) Patent No.: US 8,440,597 B2
(45) Date of Patent: May 14, 2013

(54) GRAPHITE-CONTAINING HIGH-TEMPERATURE LUBRICANT FOR HIGH-GRADE STEELS AND CARBON STEELS

(75) Inventors: Steffen Bugner, Budenheim (DE); Bernd Schneider, Wiesbaden (DE); Ralf Giskow, Mainz (DE); Thomas Futterer, Ingelheim (DE)

(73) Assignee: Chemische Fabril Budenheim KG, Budenheim (DE)

( * ) Notice: Subject to any disclaimer, the term of this patent is extended or adjusted under 35 U.S.C. 154(b) by 704 days.

(21) Appl. No.: 12/311,509

(22) PCT Filed: Sep. 21, 2007

(86) PCT No.: PCT/EP2007/060034

§ 371 (c)(1),
(2), (4) Date: Aug. 10, 2009

(87) PCT Pub. No.: WO2008/043656

PCT Pub. Date: Apr. 17, 2008

(65) Prior Publication Data

US 2009/0305918 A1 Dec. 10, 2009

(30) Foreign Application Priority Data

Oct. 9, 2006 (DE) ..... 10 2006 047 621

(51) Int. Cl.
*C10M 125/02* (2006.01)
*C10M 125/30* (2006.01)
*C10M 133/40* (2006.01)

(52) U.S. Cl.
USPC ..... 508/113; 508/255; 508/136; 508/118

(58) Field of Classification Search ..... 508/118, 508/113, 136, 255
See application file for complete search history.

(56) References Cited

U.S. PATENT DOCUMENTS

| | | | | |
|---|---|---|---|---|
| 3,379,642 | A | 4/1968 | Nielsen | |
| 4,828,728 | A * | 5/1989 | Dimigen et al. | 508/107 |
| 5,348,672 | A | 9/1994 | Ohkura et al. | |
| 6,245,725 | B1 * | 6/2001 | Tanaka et al. | 508/365 |
| 6,335,309 | B1 * | 1/2002 | Takagi et al. | 508/115 |

FOREIGN PATENT DOCUMENTS

| | | | |
|---|---|---|---|
| DE | 2450716 | A1 | 11/1975 |
| DE | 68924075 | T2 | 1/1996 |
| DE | 102004045128 | A1 | 3/2006 |
| EP | 0164637 | A1 | 12/1985 |
| EP | 0554822 | A1 | 8/1993 |
| EP | 0357508 | A1 | 10/1993 |
| EP | 0745661 | A1 | 12/1996 |
| EP | 0909309 | A1 | 4/1999 |
| WO | WO 2006/029934 | A2 | 3/2006 |
| WO | WO 2006029934 | A2 * | 3/2006 |

* cited by examiner

*Primary Examiner* — Jim Goloboy
(74) *Attorney, Agent, or Firm* — Michael L. Dunn

(57) ABSTRACT

The present invention concerns a high-temperature lubricant for the hot shaping of high-grade and carbon steels, which has a content of graphite, organic blowing agent and inorganic separation agent, and the use thereof. In order to provide a high-temperature lubricant which can be used for a wide range of steel qualities for different wall thicknesses to be rolled and stretching effects and which is moreover stable in respect of temperature, provides constant rolling results upon a change in the wall thickness and/or the quality of steel and does not lead to unwanted cementation of the rolled material, za the high-temperature lubricant according to the invention contains at least the following constituents in percent by weight with respect to the solids content:

(a) 40 to 90% by weight graphite,
(b) 2 to 50% by weight organic blowing agent, and
(c) 5 to 50% by weight inorganic separation agent, wherein the organic blowing agent (b) is selected from the group consisting of melamine, melam, melem, melon, phosphate salts and polyphosphate salts of the aforesaid compounds with phosphate chain lengths in the region of n=1 to 1000, reaction products and adducts of the aforesaid compounds with cyanuric acid or isocyanuric acid, and mixtures of the aforesaid, and the inorganic separation agent (c) is a sheet silicate or a mixture of sheet silicates.

28 Claims, No Drawings

GRAPHITE-CONTAINING HIGH-TEMPERATURE LUBRICANT FOR HIGH-GRADE STEELS AND CARBON STEELS

BACKGROUND OF THE INVENTION

The present invention concerns a high-temperature lubricant for the hot shaping of high-grade and carbon steels, which has a content of graphite, organic blowing agent and inorganic separation agent. The invention further concerns the use of the high-temperature lubricant according to the invention.

In the production of seamless pipes a solid steel block is heated to a given shaping temperature and pierced to form a thick-walled hollow block. That hollow block is fitted over a tool, the mandrel bar, and rolled out or stretched without the additional supply of heat over the mandrel bar by means of rollers bearing against the outside thereof. In that situation, in part considerable pressures and frictional forces occur on the surfaces of the metal to be worked and the working tool, and they crucially influence the durability of the working tools. In addition the frictional conditions ultimately determine the surface quality of the articles produced.

In the above-mentioned production of seamless pipes the most widely varying steel qualities are shaped, for example alloyed and highly alloyed steels and carbon steels. Different demands are made on separation agents and mandrel bar lubricants used, for those different steel qualities and for different wall thicknesses to be rolled out and stretching effects.

In consideration of the highly different material properties of the various steel material groups during the shaping procedure in the heated condition, the shaping of carbon steels mainly requires a lubricating action which is as good as possible on the part of the lubricant and, when dealing with alloyed and highly alloyed steels, in addition a separation effect which is as good as possible in respect of the lubricant is needed. In addition, high demands are made on a high-temperature lubricant in relation to temperature stability and constant rolling results upon a change in the wall thickness and/or the quality of steel.

Rolling material is to be prevented from adhering to the tool surfaces as that gives rise to serious losses in quality on the inside surfaces of the finished products. Other important considerations in relation to the shaping operation which takes place after the tools are coated with the lubricant are adhesion of the lubricant to the tool, which is as good as possible, a rapid drying effect and uniform formation of the layer consisting of applied lubricant.

When dealing with carbon-bearing lubricants such as for example graphite-bearing lubricants, so-called cementation of the rolling material can occur in the region of the grain boundaries of the rolling material upon contact with the lubricant at shaping temperatures of the order of magnitude of 1100 to 1300° C., in which case carbon diffuses into the surface of the metal and the situation can involve partial embrittlement of the metal and the formation of holes with penetration depths of up to about 300 μm. Upon further processing of the workpiece, the result of embrittlement of the metal is that the embrittled material tears apart and the workpiece becomes useless. Holes which are formed in that way are rolled out to form longitudinal scoring marks or lines in the subsequent elongation procedure. Those scoring lines represent a considerable, unacceptable reduction in quality of the finished rolled material, which has to be avoided.

Depending on the respective quality of steel and rolling process involved, different, especially adapted lubricant compositions have already been developed. The consequence of this is that, upon changes in production, for example when changing from alloyed and highly alloyed steel qualities to carbon steels, the lubricant also has to be replaced, besides the changes in process settings and rolling parameters, which have to be carried out by the rolling mechanism operator. That involves cost-intensive disadvantages, such as for example longer interruptions in production, an increased amount of work due to the conversion operations involved, the necessity to store widely varying lubricants which are matched to the material and the rolling process, the provision of additional mixing and storage containers, and the provision of a further separate apparatus for applying the alternative lubricant which is suited to the specific requirements involved.

Lubricants for the area of use of high-grade steel shaping are described for example in EP-A-0 357 508. However, they are optimised for that area of use and are therefore not the optimum for shaping carbon steels, in relation to tool service lives and current consumption levels in respect of the rollers.

Lubricants for the field of carbon steel shaping are described for example in EP-A-0 164 637, EP-A-0 554 822 and EP 0 909 309. More highly alloyed materials can be shaped with those lubricants, under comparable conditions, only when a deoxidation agent in powder form additionally assists with the lubrication effect.

EP 0 745 661 discloses a graphite-bearing lubricant which has a proportion of one or more clay minerals from the class of smectites. In addition those lubricants have either a content of silica sol or potassium aluminium silicate. In accordance with EP 0 745 661 such lubricants can very substantially overcome the disadvantage of cementation of graphite-bearing lubricants at relatively high working temperatures.

Admittedly, such lubricants with contents of graphite and sheet silicate can exhibit a lesser degree of cementation in metal working operations, but it will be noted that they are frequently in need of improvement in regard to the frictional conditions between the metal surfaces in order to prolong the durability of the working tools, for example the mandrel bars.

Therefore the object of the present invention is to provide a high-temperature lubricant which can be used for a wide range of steel qualities for different wall thicknesses to be rolled and stretching effects and which is moreover stable in respect of temperature, provides constant rolling results upon a change in the wall thickness and/or the quality of steel and does not lead to unwanted cementation of the rolled material. A high-temperature lubricant of that kind has hitherto not been described.

BRIEF SUMMARY OF THE INVENTION

That object is attained by a high-temperature lubricant for the hot shaping of high-grade and carbon steels, which contains at least the following constituents in percent by weight with respect to the solids content:

(a) 40 to 90% by weight graphite, (b) 2 to 50% by weight organic blowing agent, and (c) 5 to 50% by weight inorganic separation agent, wherein the organic blowing agent (b) is selected from melamine, melam, melem, melon, phosphate salts and polyphosphate salts of the aforesaid compounds with phosphate chain lengths in the region of n=1 to 1000, reaction products and adducts of the aforesaid compounds with cyanuric acid or isocyanuric acid, and mixtures of the aforesaid, and the inorganic separation agent (c) is a sheet silicate or a mixture of sheet silicates.

DETAILED DESCRIPTION OF THE INVENTION

The high-temperature lubricant composition according to the invention surprisingly exhibits excellent lubricating and separation properties as a lubricant which can be universally employed in relation to a very wide range of qualities of steel in hot shaping, in particular in rolling processes for the production of seamless pipes. The lubricant according to the invention is stable at high temperatures, provides constant rolled products when dealing with the most widely varying qualities of steel and with changing wall thicknesses, and, in spite of the high carbon or graphite content, does not lead to cementation phenomena to a relatively high degree, which damage the rolled material.

The high-temperature lubricant according to the invention has the substantial advantage over previously known lubricants for the hot shaping of metals that only a single lubricant composition needs to be used in a rolling mill for the most widely varying qualities of steel. By virtue thereof, upon a change in the kind of steel in the working process, long interruptions in production, an increased amount of working expenditure for changing the lubricant and storing different lubricants are avoided. Furthermore, by virtue of the fact that the lubricant according to the present invention can be universally employed, there is no need for separate apparatuses for producing, storing and applying further lubricants to be provided in a rolling mill. That means that a considerable cost saving can be achieved.

The graphite with its excellent lubricating properties is contained in the high-temperature lubricant according to the invention, in relation to the solids content, in an amount of 40 to 90% by weight. With an amount of less than 40% by weight graphite, the lubricating properties of the high-temperature lubricant according to the invention are inadequate, the drive forces for the outside tools are increased and the material which is to be shaped 'flows' too little. With an amount of more than 90% by weight graphite it is not possible to guarantee an adequate separation effect between the rolled material and the mandrel bar. In particular high-grade steels have a tendency to adhere to the tools.

In a preferred embodiment of the present invention the high-temperature lubricant contains 50 to 80% by weight graphite with respect to the solids content.

In a further preferred embodiment of the invention the graphite used in the high-temperature lubricant is crystalline or macrocrystalline graphite, preferably crystalline or macrocrystalline natural graphite. The use of amorphous graphite has proven to be inappropriate as the lubricating properties of the high-temperature lubricant become worse when using amorphous graphite and that has a directly detrimental effect on the service life of the tool. The use of spheroidal graphite has been found to be completely unsuitable.

In a further preferred embodiment of the high-temperature lubricant according to the invention the graphite has a purity >90%, preferably >95%, with respect to the carbon content of the graphite. The use of graphite with a purity of less than 90% has proven to be inappropriate as the attendant substances and impurities promote the formation of cementation effects with a simultaneous reduction in the lubricating action by virtue of the lower graphite content in the composition. A crystalline natural graphite which is suitable in accordance with the invention usually has a purity of about 96%.

In a further embodiment of the high-temperature lubricant according to the invention the graphite has a mean particle size (d50) of 5 to 40 μm, preferably 10 to 25 μm. The use of graphite with a mean particle size of less than 5 μm is unsuitable as there is no longer sufficient flake structure and that results in a lesser lubricating effect. The use of graphite with a mean particle size of more than 40 μm is unsuitable as that entails flake sizes with which disadvantages occur in handling, by virtue of a severe tendency to sedimentation.

Natural graphite of the aforementioned state of purity contains further constituents as impurities or admixed substances such as inter alia silicon in the form of silicon carbide (SiC) or silicon oxide ($SiO_2$). As silicon carbide and silicon oxide have a strongly abrasive action, an excessively high silicon content in the graphite used in accordance with the invention leads to an undesirably high level of abrasion of the tool and/or the workpiece. In a further preferred embodiment of the high-temperature lubricant according to the invention therefore the graphite used contains silicon as an impurity or admixture in an amount of not more than 2.0% by weight, preferably not more than 1.5% by weight, particularly preferably not more than 0.2% by weight.

The high-temperature lubricant according to the invention contains organic blowing agent in an amount of 2 to 50% by weight. The organic blowing agent is selected from nitrogen compounds in accordance with the above-specified definition. In a preferred embodiment of the invention the organic blowing agent contains more than 70% by weight, preferably more than 80% by weight, particularly preferably more than 90% by weight, melamine isocyanurate. In a quite particularly preferred feature the organic blowing agent consists of 100% by weight melamine isocyanurate. The organic blowing agent used in the high-temperature lubricant according to the invention liberates gas at elevated temperatures, preferably temperatures >350° C., and thus forms a gas cushion between the tool and the workpiece during shaping of the workpiece at the usual shaping temperatures. Gas formation is effected either by decomposition of the organic blowing agent, by sublimation or both. An amount of less than 2% by weight of organic blowing agent leads to inadequate gas formation or gas liberation so that an adequate gas cushion cannot be formed between the tool and the workpiece. An amount of more than 50% of organic blowing agent is unfavourable as that can involve an uncontrolledly high level of gas formation and consequential disturbance in the rolling process by gas expansion. Melamine isocyanurate is quite particularly suitable for that purpose.

In a preferred embodiment of the present invention the high-temperature lubricant contains organic blowing agent in an amount of 3 to 10% by weight, preferably 4 to 6% by weight. An amount of about 5% by weight organic blowing agent has proven to be particularly suitable.

The high-temperature lubricant according to the invention further contains a sheet silicate or a mixture of sheet silicates as an inorganic separation agent in an amount of 5 to 50% by weight. A proportion of the inorganic separation agent in an amount of less than 5% by weight is inappropriate as an adequate separation effect is not achieved. An amount of more than 50% by weight of inorganic separation agent leads to a reduced lubricating action.

In a particularly preferred embodiment of the present invention the high-temperature lubricant contains inorganic separation agent in an amount of 10 to 40% by weight, preferably 15 to 30% by weight.

In a further preferred embodiment of the high-temperature lubricant according to the invention the inorganic separation agent is selected from kaolinite, antigorite, hydrohalloysite, serpentine, greenalite, pyrophyllite, talc, margarite, vermiculite, sudoite and chlorite. Particularly preferred are kaolinite and antigorite alone or as a mixture. In a further particularly preferred embodiment of the high-temperature lubricant according to the invention the inorganic separation agent is selected from the group of alkali-free aqueous sheet silicates with a double-single sheet such as for example kaolinite, antigorite and halloysite. The clay mineral kaolinite, an aluminium hydrosilicate of the general formula $Al_2[Si_2O_5(OH)_4]$ is quite particularly preferred among the sheet silicates.

Kaolin is obtained either by elutriation of the argillaceous rock kaolin or synthetically from polysilicic acid and aluminium hydroxide. As kaolins predominantly consist of the mineral kaolinite (about 88%) kaolin can also be used in place of pure kaolinite in specific implementations of the present invention. The advantage of using the argillaceous rock kaolin is the lower costs for the raw material in comparison with the use of pure or for example synthetically produced kaolinite. In accordance with the invention therefore kaolin is preferably used. In comparison however the higher purity of the mineral kaolinite or the highest possible purity of the synthetically produced kaolinite can also be desired for the purposes of more exact reproducibility of products of uniform quality.

In a further preferred embodiment of the high-temperature lubricant according to the invention the inorganic separation agent has a mean particle size (d50) of 0.5 to 15 μm, preferably 1 to 10 μm, particularly preferably 1 to 7 μm. Smaller particle sizes than 0.5 μm suffer from the disadvantage that agglomerate formation of the raw material takes place and that cannot be homogenised sufficiently well in the powder mixture. Particle sizes of more than 15 μm suffer from the disadvantage that as a result the separation action of the separation agent is partially superposed by an abrasion effect, which has a detrimental action, and in addition it is not possible to produce a homogeneous mixture when greatly different particles sizes are involved.

In a particularly preferred embodiment of the present invention the high-temperature lubricant contains 1 to 20% by weight organic adhesive which is selected from alkylene homopolymers and copolymers. The adhesive can be suspended in water and forms on the substrate (tool and/or workpiece) a film which contributes to the other constituents of the composition of the lubricant being held. An amount of less than 1% by weight of the organic adhesive is inadequate as that means that the layer thicknesses of the lubricant used are reduced to an inadequate value. An amount of more than 20% of organic adhesive suffers from the disadvantage that the lubricating action is reduced as a result of the missing graphite proportion and the tool service lives are accordingly reduced.

In a preferred embodiment of the invention the high-temperature lubricant contains the organic adhesive in an amount of 2 to 10% by weight, preferably 2 to 5% by weight.

In a further preferred embodiment of the high-temperature lubricant according to the invention the organic adhesive is selected from homo- and copolymers of arylalkenes, α,β-unsaturated acids and esters, β,γ-unsaturated acids and esters, alkenes, vinyl esters, vinyl alcohols, unsaturated dibasic acids and esters, alkyl esters and acyclic acids and esters. Quite particularly preferably the organic adhesive is selected from polyethylene, polymethyl methacrylate, polystyrene, polybutadiene, polyvinyl acetate, polyvinyl proprionate, copolymer of methyl methacrylate and styrene, copolymer of methylene methacrylate and alphamethyl styrene, polydiallyl phthalate, polypropylene, copolymer of styrene and butadiene, polymethyl methacrylate, copolymer of vinyl acetate and dibutyl maleinate, copolymer of vinyl acetate and ethylene and polyisobutylene.

In a further particularly preferred embodiment of the present invention the high-temperature lubricant further contains 2 to 15% by weight inorganic or organic stabiliser, the stabiliser being selected from polysaccharides, alkyl celluloses, hydroxycelluloses and clay minerals. The high-temperature lubricant according to the invention in use is frequently or usually employed in the form of a suspension or dispersion in a liquid, preferably in water. The inorganic stabiliser increases the viscosity in that suspension or dispersion and thus serves as a thickening agent and prevents or reduces sedimentation and thus separation of the other constituents of the high-temperature lubricant. An amount of less than 2% by weight of the stabiliser is undesirable as then the increase in viscosity is not sufficient to adequately prevent sedimentation of the constituents of the high-temperature lubricant and to ensure homogeneity of the lubricant. An amount of not more than 15% by weight of the stabiliser leads to an increase in the viscosity of the suspension or dispersion so that it can only be poorly applied to the tool by a spray process. Furthermore an excessively high viscosity can adversely affect the formation of a sufficiently cohesive and uniformly thick film of lubricant.

In a preferred embodiment of the invention the high-temperature lubricant contains the stabiliser in an amount of 3 to 10% by weight, preferably 4 to 6% by weight. Particularly preferably the stabiliser is an inorganic material which is selected from clay minerals on a silicate basis or mixtures thereof, preferably from bentonites and organically modified bentonites. Quite particularly preferably the stabiliser is selected from clay minerals from the class of smectites, preferably the class of montmorrionites.

Smectites substantially comprise sheet silicates and by virtue of the structure involved are distinguished by a high cation exchange capability and a high degree of swellability in water. In the class of smectites, montmorrionites are particularly preferably used, which have a swelling capacity (1 g of montmorrionite in distilled water) of 3 to 50. By virtue of the above-mentioned cation exchange capability the smectites or montmorrionites can be 'modified' with inorganic or organic cations. The clay minerals advantageously used in the high-temperature lubricant according to the invention are distinguished by excellent binding properties and also enjoy the advantage that, in contrast to organic stabilisers, they are not subject to pyrolysis. Furthermore the use of the specified clay minerals leads to a surprisingly fast drying time for the film of lubricant on the workpiece and/or the tool within a few seconds. The use of those stabilisers makes it possible with the lubricant according to the invention to produce a uniform and dry lubricant film on the tool and/or the workpiece within a very short time, even before the tool and the workpiece are brought into contact.

Desirably, as a commercial product, the high-temperature lubricant according to the invention is prepared in the form of a dry solid material in powder form. It can also be used directly as such a solid material, but it is advantageous for it to be employed in the situation of use in the form of a suspension or dispersion in a liquid, preferably water, with a solids content of 5 to 50% by weight, preferably 15 to 40% by weight, particularly preferably 25 to 30% by weight. In that way the high-temperature lubricant can be uniformly sprayed on to the tool and/or the workpiece. By virtue of the elevated temperature of the tool and/or the workpiece the liquid evaporates and leaves behind a uniform firm coating of the lubricant. It will be appreciated that the high-temperature lubricant according to the invention can also be marketed in the form of such a suspension or dispersion.

In a further preferred embodiment of the present invention the solid constituents of the high-temperature lubricant are of a mean particle size<200 μm, preferably <150 μm, particularly preferably 100<mm. If the solid constituents of the high-temperature lubricant are of a greater mean particle size, that suffers from the disadvantage of increased tendency to sedimentation in a suspended form of application.

Further advantages, features and embodiments of the present invention are described with reference to the examples hereinafter.

EXAMPLE 1

Four different lubricant recipes were tested in longitudinal rolling processes. The recipes were each used in the form of 30% aqueous suspensions. All percentages by weight relate in each case to the solids content. In the longitudinal rolling processes, pipes with thin walls (wall gauge=4.1 mm) were produced at mandrel bar temperatures of 80-100° C. About 90 g of lubricant suspension per $m^2$ was applied. The flow time of the suspensions in accordance with EN-ISO 2431 (6 mm) was about 50 sec. The rolling batches included in each case about 50 to 2000 pipes. The materials used were a carbon steel of the quality P110 and an alloyed steel of the quality P91.

The recipes, produced by mixing of the constituents, of the dry lubricants in powder form and the rolling results are set forth in Table 1 hereinafter. As thin wall gauges, by virtue of the greater degree of stretching, require better lubrication than thick wall gauges, the results of the lubricating action can also be transferred on to the thick wall range.

The components (a) to (f) and (x) and (y) used in the recipes are characterised in greater detail hereinafter.

| | |
|---|---|
| (a) Graphite | macrocrystalline natural graphite,<br>purity: 94-96%<br>C-content: 94-97%<br>mean particle size d50 (Cilas): about 15 μm<br>Si-content: about 0.2% by weight $SiO_2$<br>moisture content: <0.2% |
| (b) Organic blowing agent | melamine isocyanurate, Budit 315 ®,<br>Chemische Fabrik Budenheim KG, Germany;<br>N-content: 48%,<br>free melamine: <0.5%,<br>free isocyanuric acid: <0.2% |
| (c) Inorganic separation agent | kaolin,<br>mean particle size d50 (Cilas): 2-10 μm,<br>Si-content: >50% by weight $SiO_2$,<br>Al-content: about 30% by weight $Al_2O_3$, |
| (d) Organic adhesive | styrene-acrylic acid ester copolymer in powder form<br>Bulk density: 400-600 g/l<br>grain size (sieving over 315 μμm in accordance with DIN 66165): <3 m<br>glass transition temperature ($T_g$ in accordance with DIN 53765-A-10): 15° C. |
| (e) Inorganic stabiliser | organically modified smectite in powder form<br>viscosity (3%, Haake): 40000--50000 mPas<br>grain size (sieving over 90 μm): max 25% |
| (f) Bactericide | isothiazolinone preparation,<br>Acticide MBP ®, Thor-Chemie GmbH, Germany |
| (x) Blowing agent | asphalt,<br>Zeco 11A, Ziegler Chemicals & Minerals Corp, USA |
| (y) Blowing agent | lignin sulphonate,<br>Borresphere NA220, Borregaad Ligno-Tech, Germany |

TABLE 1

| Recipe | Components | Composition (% by weight) | Rolling results[1)] C-steel P100 | Alloy. steel P91 |
|---|---|---|---|---|
| 1 (invention) | (a) graphite | 66.2 | +++ | +++ |
| | (b) organic blowing agent | 5.0 | | |
| | (c) inorganic separation agent | 21.0 | | |
| | (d) organic adhesive | 3.0 | | |
| | (e) inorganic stabiliser | 4.3 | | |
| | (f) bactericide | 0.5 | | |
| 2 (comparative recipe) | (a) graphite | 66.2 | +++ | −−− |
| | (x) organic blowing agent | 5.0 | | |
| | (c) inorganic separation agent | 21.0 | | |
| | (d) organic adhesive | 3.0 | | |
| | (e) inorganic stabiliser | 4.3 | | |
| | (f) bactericide | 0.5 | | |
| 3 (comparative recipe) | (a) graphite | 66.2 | +++ | −−− |
| | (y) organic blowing agent | 5.0 | | |
| | (c) inorganic separation agent | 21.0 | | |
| | (d) organic adhesive | 3.0 | | |
| | (e) inorganic stabiliser | 4.3 | | |
| | (f) bactericide | 0.5 | | |
| 4 (comparative recipe in accordance with EP 0 909 309) | (a) graphite | 85.0 | +++ | +/− |
| | bentonite | 3.0 | | |
| | Na-silicate | 2.5 | | |
| | silicophosphate | 0.8 | | |
| | phosphate mixture | 8.7 | | |

[1)]Rolling results:
'+++' very good rollability, low current consumption, good accuracy to size of the finished pipe
'+/−' difficult rollability, high current consumption, in part internal pipe flaws, residues at the tool surface
'−−−' poor rollability, lubricant cannot be satisfactorily used.

EXAMPLE 2

Production of a Seamless High-Grade Steel Pipe

In a seamless pipe production line in which, after piercing of the preliminary material on a skew rolling mill, elongation of the hollow blocks produced in that way is effected by means of continuously operating, respectively separately driven roll stands on a freely movable tool (mandrel bar), the mandrel bar was coated at a temperature of about 110 to 130° C. by means of an airless spray installation (4×0.7/0.9 mm nozzles/40-80 bars) prior to the operation of elongating the hollow blocks, with the lubricant suspension produced in accordance with recipe 1 from Example 1. The material used was ferritic steel with 9 and 13% Cr respectively and the hollow blocks weighed from 250 to 270 kg and were from 6 to 8 m in length. The shaping temperature was 1150 to 1200° C. The wall gauges of the finished pipes were 2.7 to 7.3 mm, predominantly however 4.1 mm, and the outside diameter of the finished pipes was 152 mm at a maximum.

EXAMPLE 3

Production of Seamless Carbon Steel Pipes

Seamless pipes of carbon steel were produced on the same production line as in Example 2, while retaining the set installation rolling adjustments. Coating of the mandrel bars was effected with the lubricant of recipe 1 from Example 1 and in the manner described in Example 2. The material was steel of the quality P110 and P91 respectively and the hollow blocks weighed from 250 to 300 kg and were from 6.5 to 8 m in length. The shaping temperature was 1250 to 1280° C. The wall gauges of the seamless pipes produced were in the range of 2.7 to 4.1 mm and the finished pipes were of an outside diameter of 152 mm maximum.

What is claimed is:

1. A high-temperature lubricant for the hot shaping of high-grade and carbon steels, which contains at least the following constituents in percent by weight with respect to the solids content:

(a) 40 to 90% by weight graphite, (b) 2 to 50% by weight organic blowing agent, and (c) 5 to 50% by weight inorganic separation agent, wherein the organic blowing agent (b) is selected from the group consisting of melamine, melam, melem, melon, phosphate salts and polyphosphate salts of the aforesaid compounds with phosphate chain lengths in the region of n=1 to 1000, reaction products and adducts of the aforesaid compounds with cyanuric acid or isocyanuric acid, and mixtures of the aforesaid, and the inorganic separation agent (c) is a sheet silicate or a mixture of sheet silicates;

and wherein the inorganic separation agent (c) has a mean particle size (d50) of 0.5 to 15 μm.

2. A high-temperature lubricant according to claim 1 which further contains (d) 1 to 20% by weight organic adhesive, wherein the organic adhesive (d) is selected from alkylene homopolymers and copolymers.

3. A high-temperature lubricant according to claim 2 which further contains (e) 2 to 15% by weight inorganic or organic stabiliser, wherein the stabiliser is selected from polysaccharides, alkyl celluloses, hydroxy celluloses and clay minerals.

4. A high-temperature lubricant according to claim 1 wherein the high-temperature lubricant contains graphite (a) in an amount of 50 to 80% by weight.

5. A high-temperature lubricant according to claim 1 wherein the graphite (a) is crystalline or macrocrystalline graphite.

6. A high-temperature lubricant according to claim 1 where the graphite (a) has a purity greater than 90% with respect to the carbon content of the graphite.

7. The high-temperature lubricant according to claim 1 where the graphite (a) has a purity greater than 95%.

8. A high-temperature lubricant according to claim 1 where the graphite (a) has a mean particle size (d50) of 5 to 40 μm.

9. A high-temperature lubricant according to claim 1 where the graphite (a) contains silicon as an impurity or admixture in an amount of not more than 1.5% by weight.

10. A high-temperature lubricant according to claim 1 wherein the high-temperature lubricant contains organic blowing agent (b) in an amount of 3 to 10% by weight.

11. A high-temperature lubricant according to claim 1 where the organic blowing agent (b) contains more than 70% by weight melamine isocyanurate.

12. A high-temperature lubricant according to claim 1 wherein the inorganic separation agent (c) comprises a clay mineral selected from alkali-free aqueous sheet silicates.

13. A high-temperature lubricant according to claim 1 wherein the inorganic separation agent (c) is selected from kaolinite, antigorite, hydrohalloysite, serpentine, greenalite, pyrophyllite, talc, margarite, vermiculite, sudoite and chlorite.

14. A high-temperature lubricant according to claim 1 wherein the inorganic separation agent (c) is kaolinite, antigorite or mixtures thereof.

15. A high-temperature lubricant according to claim 1 wherein the inorganic separation agent (c) is an alkali-free aqueous sheet silicate with a double-single sheet.

16. A high-temperature lubricant according to claim 2 wherein the high-temperature lubricant contains adhesive (d) in an amount of 2 to 10% by weight.

17. A high-temperature lubricant according to claim 2 wherein the organic adhesive (d) comprises an alkylene homo-or co-polymer of: arylalkenes, α,β-unsaturated acids and esters, β,γ-unsaturated acids and esters, alkenes, vinyl esters, vinyl alcohols, unsaturated dibasic acids and esters, alkyl esters and acyclic acids and esters, polyethylene, polymethyl methacrylate, polystyrene, polybutadiene, polyvinyl acetate, polyvinyl proprionate, copolymer of methyl methacrylate and styrene, copolymer of methylene methacrylate and alphamethyl styrene, polydiallyl phthalate, polypropylene, copolymer of styrene and butadiene, polymethyl methacrylate, copolymer of vinyl acetate and dibutyl maleinate, copolymer of vinyl acetate and ethylene and polyisobutylene.

18. A high-temperature lubricant according to claim 3 where the high-temperature lubricant contains stabiliser (e) in an amount of 3 to 10% by weight.

19. A high-temperature lubricant according to claim 18 wherein the stabiliser (e) is a clay mineral.

20. A high-temperature lubricant according to claim 18 wherein the stabiliser (e), contains a clay mineral selected from bentonites, organically modified bentonites, and smectites.

21. A high-temperature lubricant according to claim 18 wherein the stabiliser (e), contains a montmorillonite clay mineral.

22. A high-temperature lubricant according to claim 1 wherein the high-temperature lubricant is in the form of a dry solid material in powder form.

23. A high-temperature lubricant according to claim 1 wherein the high-temperature lubricant is in the form of a suspension or dispersion in a liquid.

24. The high temperature lubricant of claim 23 where the liquid is water and solid content is 15 to 40% by weight.

25. A high-temperature lubricant according to claim 1 wherein solid constituents are of a mean particle size<200 μm.

26. A method for hot shaping of high grade and carbon steels comprising using the high temperature lubricant of claim 1.

27. A high-temperature lubricant for the hot shaping of high-grade and carbon steels, which contains at least the following constituents in percent by weight with respect to the solids content:

(a) 40 to 90% by weight graphite, (b) 2 to 50% by weight organic blowing agent, and (c) 5 to 50% by weight inorganic separation agent, and (d) 1 to 20% by weight organic adhesive, wherein the organic blowing agent (b) is selected from the group consisting of melamine, melam, melem, melon, phosphate salts and polyphosphate salts of the aforesaid compounds with phosphate chain lengths in the region of n=1 to 1000, reaction products and adducts of the aforesaid compounds with cyanuric acid or isocyanuric acid, and mixtures of the aforesaid, and the inorganic separation agent (c) is a sheet silicate or a mixture of sheet silicates; and wherein the organic adhesive (d) is selected from alkylene homopolymers and copolymers.

28. A high-temperature lubricant according to claim 1 wherein the high-temperature lubricant contains inorganic separation agent (c) in an amount of 15 to 30% by weight.

* * * * *

UNITED STATES PATENT AND TRADEMARK OFFICE

CERTIFICATE OF CORRECTION

PATENT NO. : 8,440,597 B2
APPLICATION NO. : 12/311509
DATED : May 14, 2013
INVENTOR(S) : Bugner et al.

It is certified that error appears in the above-identified patent and that said Letters Patent is hereby corrected as shown below:

On the title page Item [73] "Fabril" should read --Fabrik--
Chemische Fabrik Budenheim KG, Budenheim (DE)

Signed and Sealed this
Twenty-second Day of April, 2014

Michelle K. Lee

Michelle K. Lee
*Deputy Director of the United States Patent and Trademark Office*